US005984124A

United States Patent [19]

Takano

[11] Patent Number: 5,984,124

[45] Date of Patent: Nov. 16, 1999

[54] PILFER-PROOF CAP MADE OF SYNTHETIC RESIN

[75] Inventor: Takafusa Takano, Hyogo, Japan

[73] Assignee: Yamamura Glass Co., Ltd., Nishinomiya Hyogo, Japan

[21] Appl. No.: 08/976,904

[22] Filed: Nov. 24, 1997

Related U.S. Application Data

[63] Continuation of application No. 08/510,598, Aug. 3, 1995.

[30] Foreign Application Priority Data

Aug. 6, 1994 [JP] Japan ..... 6-204354

[51] Int. Cl.[6] ..... B65D 41/34; B65D 53/04

[52] U.S. Cl. ..... 215/252; 215/253; 215/258; 215/345; 215/350

[58] Field of Search ..... 215/211, 252, 215/288, 307, 350, 354, 352, 349, 253, 254, 258, 329, 341, 343, 345; 220/303, 304, 366.1, 265, 266, 276, 288, 378

[56] References Cited

U.S. PATENT DOCUMENTS

| | | | |
|---|---|---|---|
| 2,235,101 | 3/1941 | Enkur | 220/366.1 X |
| 2,456,607 | 12/1948 | Shaffer | 215/350 |
| 2,681,742 | 6/1954 | Miller | 215/350 |
| 3,438,528 | 4/1969 | Fields | 215/252 |
| 3,455,478 | 7/1969 | Fields et al. | 215/252 |
| 3,788,510 | 1/1974 | Collins | 215/354 X |
| 4,473,163 | 9/1984 | Geiger . | |
| 4,971,219 | 11/1990 | Dombeck et al. | 215/307 X |
| 4,997,097 | 3/1991 | Krautkramer | 215/307 |
| 5,421,470 | 6/1995 | Dudzik | 215/354 X |
| 5,579,936 | 12/1996 | Costa et al. | 215/349 X |

FOREIGN PATENT DOCUMENTS

| | | | |
|---|---|---|---|
| 201613 | 5/1985 | European Pat. Off. . | |
| 261047 | 3/1988 | European Pat. Off. . | |
| 269920 | 6/1988 | European Pat. Off. . | |
| 0473529 | 3/1992 | European Pat. Off. | 215/350 |
| 636550 | 2/1995 | European Pat. Off. . | |
| 2528393 | 6/1983 | France . | |
| 6225655 | 7/1985 | Japan . | |
| 534148 | 5/1993 | Japan . | |
| 6204354 | 7/1995 | Japan . | |
| 8304402 | 12/1983 | WIPO | 215/252 |

*Primary Examiner*—Stephen K. Cronin
*Assistant Examiner*—Niki M. Eloshway
*Attorney, Agent, or Firm*—Price, Gess & Ubell

[57] ABSTRACT

A pilfer-proof cap made of synthetic resins capable of preventing at least a rotation of a packing together with a cap in a simple construction when said cap is removed and holding a sealed-up tightness of a container until a bridge is broken is provided.

A cap, in which a top wall and a skirt depending from said top wall are comprised and a threaded portion of the cap screwed in a threaded portion of the container is provided, a plurality of bridges, a packing provided so as to seal up tightly a mouth portion of container during the time when said cap is closed, a packing guide, a circular inner sealing member tightly insertable into an inner surface of said mouth portion of container provided in said packing and an air reservoir formed in an upper surface of the packing are comprised.

15 Claims, 6 Drawing Sheets

PILFER-PROOF CAP MADE OF SYNTHETIC RESIN

This is a continuation of application Ser. No. 08/510,598, filed on Aug. 3, 1995.

BACKGROUND OF THE INVENTION

1. Field of the Invention

The present invention relates to a pilfer-proof cap made of synthetic resins to be put on a mouth portion of containers such as bottles for use in drinks.

2. Description of the Prior Art

A pilfer-proof cap having a container-sealing packing (hereinafter referred to as a packing), in which said packing is held at an appointed position on an inside surface of a top wall of a cap to be simultaneously lifted up together with said cap, whereby releasing a sealing for said container by the packing, when said cap is removed from said container, has been proposed (refer to Japanese Publication No. Sho 62-18421).

However, with such a construction, there has still been the possibility that the packing is lifted up together with the cap or is not removed from, but rather is rotated together with the cap to release said sealing for the container, whereby breaking an airtightness, while a bridge holding a band for mechanically engaging the cap with said mouth portion of the container is not broken, when a cap-opening action out of mischief and the like, so-called a slight rotation, is conducted while the cap is not fully removed.

The cap of this type is not preferably used in view of a protection for contents in the container in the case where a pressure within a tightly sealed-up container filled with contents is higher than that outside of said container (1), the case where said pressure within the tightly sealed-up container becomes equal to a pressure outside of the container and a packing is continuously adhered closely to a mouth portion of the container (2), or the case where it is used for tightly sealing up the container filled with a liquid heat treated at a high temperature or the container which is subjected to a high-temperature heat treatment after being filled with a liquid followed by being cooled to room temperature and, as a result, an inner pressure of the tightly sealed-up container is reduced and a packing is continuously adhered closely to a mouth portion of the container by a vacuum generated within the container (3). For example, in the case of the above described (1), a gas is leaked, and in cases of the above described (2), (3), the open air is apt to enter the container together with bacteria and, consequently, the contents of the container are apt to be denatured and corrupted in all of the above described cases (1), (2) and (3).

SUMMARY OF THE INVENTION

The present invention has been achieved in view of the above described problems and it is an object of the present invention to provide a pilfer-proof cap capable of preventing at least a rotation of a packing together with a cap in a simple construction when said cap is removed and holding a sealed-up tightness of a container until a bridge is broken.

In order to achieve the above described object, a pilfer-proof cap made of synthetic resins and comprising a cap, in which a top wall and a skirt depending from said top wall are comprised and a threaded portion of said cap screwed in a threaded portion of said container formed in an outer circumferential surface of a mouth portion of container is provided in an inner circumferential surface of said annular skirt. A pilfer-proof band is integrally connected to the bottom edge of the skirt through a plurality of bridges and a packing is provided so as to tightly seal up said mouth portion of the container when said cap is loosened. According to the present invention an airtightness of the mouth portion of said container by said packing is held until said bridges are broken. A packing guide is capable of lifting up the packing above the mouth portion of the container and the packing is provided with an inner sealing member tightly insertable into an inner surface of the mouth portion of said container.

In addition, in view of a further point, the present invention provides a pilfer-proof cap made of synthetic resins and comprising a cap, in which a top wall and a skirt depending from said top wall are comprised and a threaded portion of a cap screwed in a threaded portion of a container formed in an outer circumferential surface of a mouth portion of the container is provided in an inner surface of said skirt. A pilfer-proof band is integrally connected to the bottom edge of said skirt through a plurality of bridges and packing is provided so as to tightly seal said mouth portion of the container when said cap is loosened, characterized in that an airtightness of the mouth portion of the container by said packing is held until said bridges are broken, a packing guide capable of lifting up the packing above the mouth portion of the container is provided, and the packing is provided with an air reservoir formed in an upper surface thereof. The air reservoir can be formed in an upper surface thereof. The air reservoir can be formed in a lower surface of the top wall opposite to said upper surface of the packing.

Moreover, in view of a still further point, the present invention provides a pilfer-proof cap made of synthetic resins and comprising a cap, in which a top wall and a skirt depending from said top wall are comprised and a threaded portion of the cap screwed in a threaded portion of the container, formed in an outer circumferential surface of a mouth portion of the container, is provided in an inner surface of said skirt. A pilfer-proof band is integrally connected to the bottom edge of said skirt through a plurality of bridges and a packing is provided so as to tightly seal up said mouth portion of the container when said cap is loosened, characterized in that an airtightness of the mouth portion of the container by said packing is held until said bridges are broken, a packing guide capable of lifting up the packing above the mouth portion of the container being provided, the packing being provided with an inner sealing member tightly insertable into an inner surface of the mouth portion of the container, and the packing being provided with an air reservoir formed in an upper surface thereof. The air reservoir can be formed in a lower surface of the top wall opposite to said upper surface of the packing.

According to the present invention, said packing guide comprising a circular projection provided in said inner circumferential surface of the skirt can be used. That is to say, said circular projection functions so as to mount the cap on the mouth portion of the container under the condition that the packing is held on the lower surface side of the top wall of the cap when the cap is screwed onto the container. Thus, the mouth portion of the container can be tightly sealed up by means of the packing held by the circular projection between the lower surface of the top wall and the circular projection between the lower surface of the top wall and the circular projection by rotating the cap in the cap-closing direction and moving the threaded portion of the cap along the threaded portion of the container. In addition, this circular projection functions so as to hold the airtightness of the mouth portion of the container by means of the packing at least until the bridges are broken even though the threaded portion of the cap moves along the threaded portion of the container when the cap is loosened and lift up the packing above the mouth portion of the container when the bridges are broken. As shown in, for example, FIGS. 1 and 4, the circular projection may be provided integrally with the cap at a position far from the lower surface of the top wall 1 by an appointed distance D between the threaded portion 5 of the cap and the top wall 1 or may be formed separately from the cap at the same position. That is to say, this circular projection as the packing guide can hold the airtightness of the container by means of the packing until the bridges are broken and lift up the packing to break the seal when the bridges are broken.

Moreover, in view of said appointed distance D, it is also possible that the uppermost portion of the conventional threaded portion of the cap is used in place of the circular projection.

According to the present invention, the packing can be made of conventionally used materials such as paper and synthetic resin.

This packing (hereinafter referred to merely as packing) is used in the following cases:

① the case where the inner pressure of the sealed-up container is reduced when the container is filled with a liquid heat treated at the high temperature or subjected to the high-temperature heat treatment after being filled with a liquid, followed by being cooled to room temperature;

② the case where the pressure within the tightly sealed-up container filled with the contents becomes higher than that outside of the container; and ③ the case where the pressure within the tightly sealed-up container becomes equal to that outside of the container.

According to the present invention, (A) At first, in the case where the contents are held under the depressurized condition as shown in the above described ①, in order to prevent at least the packing from being rotated together with the cap when the cap is loosened, air reservoirs 12 are formed in the upper surface of the packing or in the lower surface of the top wall opposite to the upper surface of the packing. As shown in, for example, FIG. 2, said air reservoirs 12 comprising a plurality of grooves 13 formed concentrically in the circumferential direction (the H-direction) of divided pieces 14 on said divided pieces 14, respectively, circular concave portions 15 surrounded by the respective divided pieces 14 and gaps N between the divided pieces 14 are formed on the upper surface of the packing 9. Although the air layer naturally remains between the lower surface of the top wall 1 and the packing 9 during the time when the cap is closed, according to the present invention, it is preferable that gaps M are formed in a threaded portion 4 of a mouth portion 3 of the container so that the air a, which has passed through said gaps M, may flow into said concave portions 15 and said grooves 13 of the divided pieces 14 through said gaps N between the divided pieces 14 to positively form the air layer between the lower surface of the top wall 1 and the upper surface of the packing 9 during the time when the cap is closed, as shown in FIG. 2. In addition, the air a to the air layer may be supplied by forming gaps in a threaded portion 5 of the cap in place of the gaps M formed in said threaded portion 4 of container.

(B) Next, in the case where the contents are held under the pressurized condition as mentioned in the above described ②, in order to prevent the packing from being rotated together with the cap when the cap is loosened, a packing 9 provided with an inner sealing member 11 tightly inserted into an inner surface of the mouth of the container is used. As shown in, for example, FIGS. 1 and 2, said packing 9 is provided with a circular inner sealing member 11 formed in the lower surface thereof. It is preferable that a length L of said inner sealing member 11 insert is selected as follows in order to improve the airtightness.

According to the present invention, it is preferable in view of said improvement of the airtightness and the prevention of the packing from being rotated together with the cap that said length L of the inner sealing member insert is set so as to be a length D from the lower surface of the top wall 1 to the upper end of the circular projection 10 or more ($L \geqq D$). Also, the packing 9 integrally moves upward with an upward movement of a cap 6 after the cap is loosened by said distance D by setting the length L of the inner sealing member inserted so as to be said length D or more, the airtightness is held at that position until the bridges are broken.

In addition, according to the present invention, in the case where the pressure within the sealed-up container becomes equal to that outside of the container, the packing provided with the inner sealing member as mentioned in the above described (B) may be used or the air reservoir may be formed in the upper surface of the packing or the lower surface of the top wall opposite to the upper surface of the packing, as mentioned in the above described (A), to prevent the packing from being rotated together with the cap.

In case of the pilfer-proof cap made of synthetic resins used for tightly sealing up the container holding the contents under the depressurized condition, the inside of the container is depressurized to generate a vacuum there when the container is filled with a liquid heat treated at a high temperature or subjected to a high-temperature heat treatment after being filled with the liquid, followed by being cooled to room temperature, whereby continuing to tightly seal up the mouth portion of a container by the packing as long as the force lifting up the packing is not generated. Consequently, even though the cap-loosening action is conducted to an extent of not fully removing the cap by mischief and the like, the air layer is formed between the lower surface of the top wall and the upper surface of the packing by the air reservoir provided in the upper surface of the packing or in the lower surface of the top wall opposite to the upper surface of the packing, so that the packing can be prevented from at least being rotated together with the cap, whereby holding the airtightness within the container at least until the bridges are broken in view of the elongation of the bridges. After at least the bridges are broken, the packing holding the above described vacuum seal can be lifted up together with the cap by means of the packing guide to open the container.

In the case where the contents are held under a pressurized condition, the packing provided with the inner sealing member tightly insertable into the inner surface of the mouth of the container is used, so that, even though the cap-loosening action is conducted to an extent of not fully removing the cap by mischief and the like, the packing can be prevented from at least being rotated together with the cap, whereby holding the airtightness within the container. After at least the bridges are broken, the packing holding the seal can be lifted up together with the cap by means of the packing guide to open the container.

DETAILED DESCRIPTION OF THE PREFERRED EMBODIMENTS

One preferred embodiment of a pilfer-proof cap made of synthetic resins according to the present invention will be described below with reference to the drawings. However, the present invention is not limited by this preferred embodiment.

Figure 1:
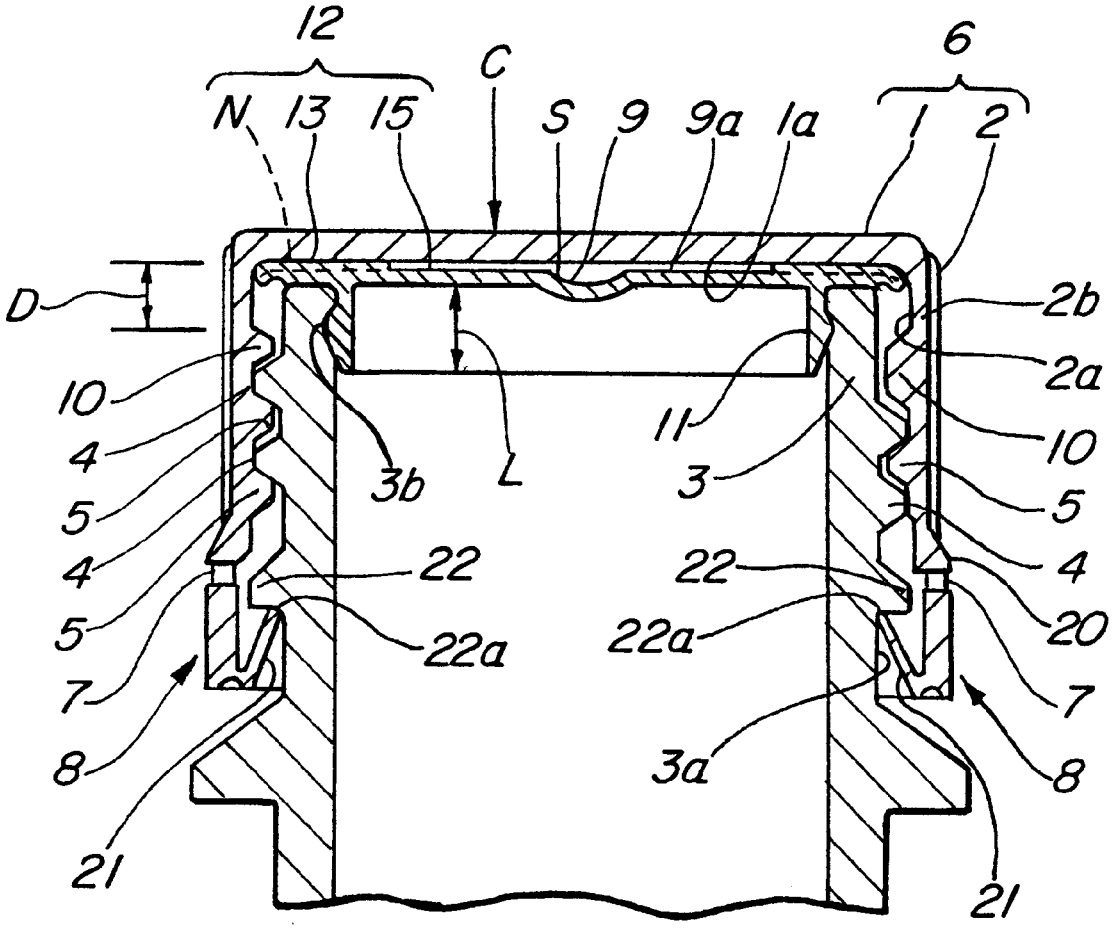
FIG. 1 is a block diagram showing a condition that a cap is closed in one preferred embodiment of a pilfer-proof cap made of synthetic resins according to the present invention.
Figure 2A:
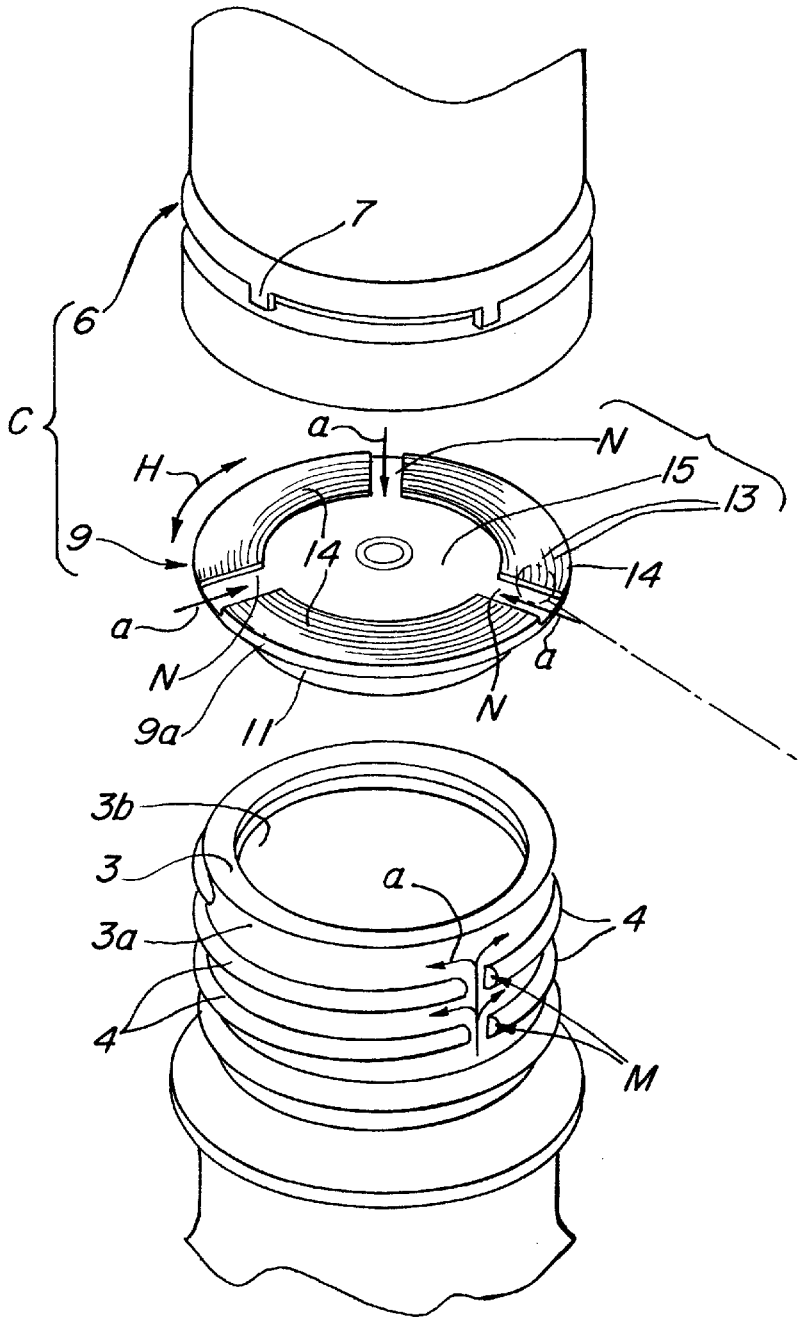
FIG. 2 is an exploded perspective view showing the above described preferred embodiment.
Figure 2B:
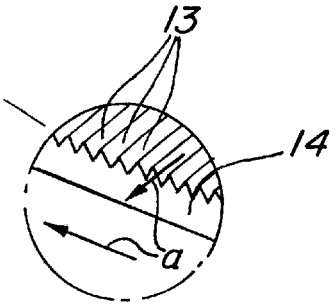
Figures 3A, 3B:
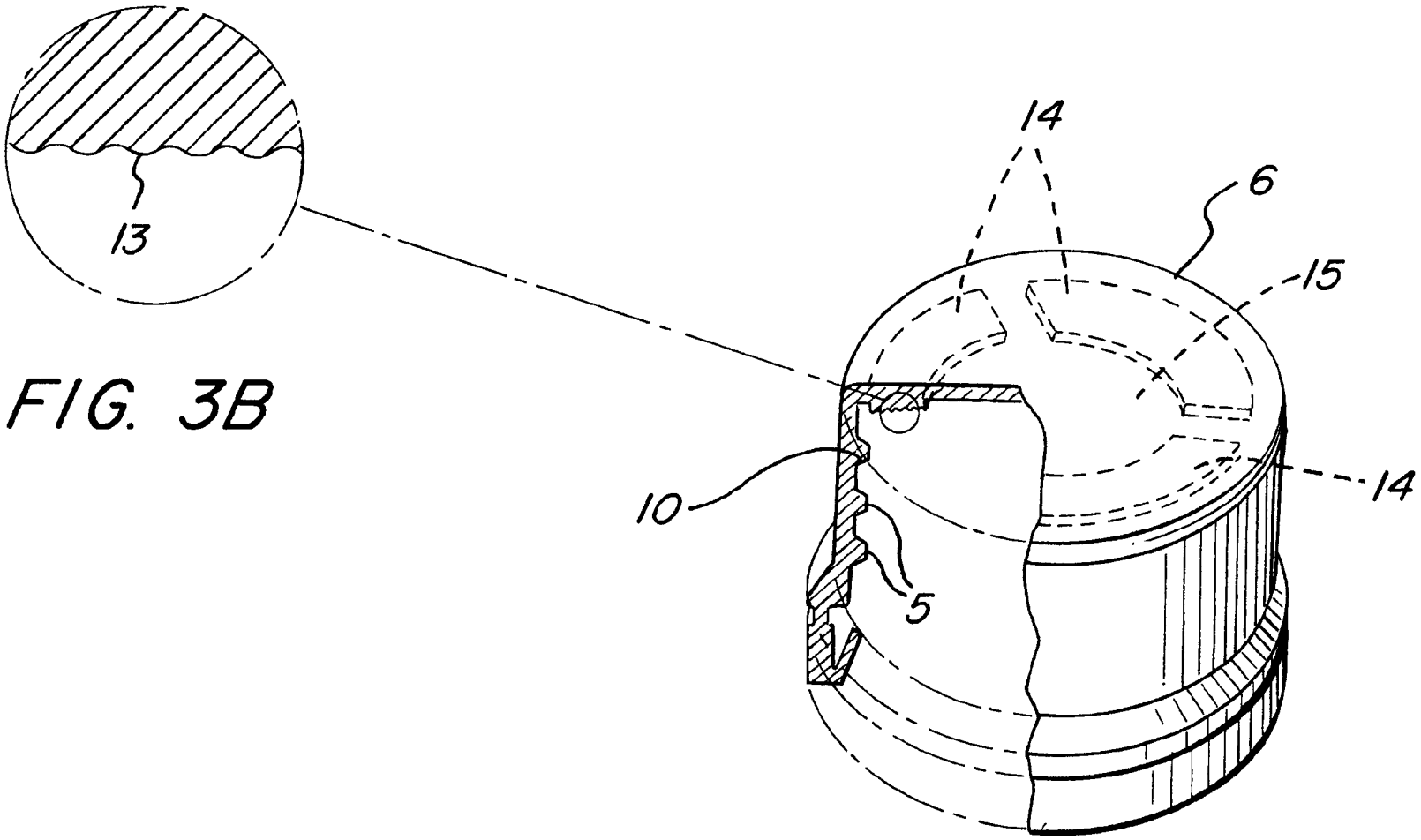
FIG. 3 is a partially cut off perspective view showing said cap in another embodiment.

Referring to FIGS. 1 to 3, a pilfer-proof cap made of synthetic resins (hereinafter referred to as a cap) C comprises a cap 6, in which a circular as seen in plan top wall 1 and an annular skirt 2 depending from said top wall 1 are comprised and a threaded portion 5 of a cap screwed in a threaded portion 4 of a container formed in an outer circumferential surface 3*a* of a mouth portion 3 of the container is provided in an inner circumferential surface 2*a* of said annular skirt 2. Pilfer-proof bands (hereinafter referred to as PP bands) 8, 8 are integrally connected with said cap 6 through a plurality of bridges 7, 7. A packing 9 is provided in the cap 6 so as to tightly seal up said mouth portion 3 of the container during the time when said cap is closed. A packing guide 10 is provided between said threaded portion 5 of the cap in said inner circumferential surface 2*a* of the skirt 2 and the top wall 1 so as to be capable of holding an airtightness of the mouth portion 3 of the container by said packing 9 until said bridges 7 are broken and lifting up the packing 9 above the mouth portion 3 of the container as soon as the bridges 7 are broken when the cap is loosened. A circular inner sealing member 11, by means of which the packing 9 is tightly insertable into an inner surface 3*b* of the mouth portion 3 of the container, and an air reservoir 12, in which the air a flows from said outer circumferential surface 3*a* of the mouth portion 3 of the container during the time when the cap is closed, is formed in an upper surface 9*a* of the packing 9.

Referring to FIG. 2, said air reservoirs 12 formed on the upper surface of the packing 9 comprises a plurality of grooves 13 formed concentrically in the circumferential direction (the H-direction) of divided pieces 14 on said divided pieces 14, respectively, circular concave portions 15 surrounded by the respective divided pieces 14 and gaps N between the divided pieces 14. During the time when the cap is closed, the air a, which has passed through gaps M formed in threaded portions 4, 4 of the container on an outer circumferential surface 3*a* of a mouth portion 3 of the container, flows in said concave portions 15 and said grooves 13 of the divided pieces 14 through said gaps N between the divided pieces 14 to form the air layer S between the lower surface 1*a* of the top wall 1 and the upper surface 9*a* of the packing 9.

In addition, said inner sealing member 11 formed in the lower surface of the packing 9 aims at an improvement of the airtightness and the prevention of the packing from being rotated together with the cap and a length L of the inner sealing member 11 inserted into the inner surface of the mouth of the container is set so as to be a length D from the lower surface of the top wall 1 to the upper end of said packing guide 10 or more ($L \geqq D$).

Moreover, the packing guide 10 comprises a circular projection formed integrally with the cap 6 along the inner circumferential surface 2*a* of the skirt 2 of the top wall 1. Said circular projection 10 is provided at a position far from the lower surface of the top wall 1 by said distance D, as above described. Furthermore, this cap C is made of thermoplastic synthetic resins, such as polyethylene and polypropylene by, for example, the injection molding method and other suitable methods. A plurality of bridges 7 hang at suitable intervals from a bottom edge 20 of the skirt 2 to hold said PP bands 8. The PP bands 8 are folded back inward so as to have suitable elasticity to be formed in the form of a plurality of projections 21 at intervals at lower ends thereof. Said projections 21 are engaged with lower engaging portions 22*a* of shoulder portions 22 provided around the mouth portion 3 of the container on the idle end sides thereof under the condition that the cap C is perfectly mounted on the mouth portion 3 of the container to mechanically engage the PP bands 8 with the mouth portion 3 of the container. In addition, suitable serrations are formed in the outer circumferential surface 2*b* of the skirt 2. Additionally, referring to FIG. 1, although the threaded portions 4 of the container and the threaded portions 5 of the cap are continuous in series, respectively, a plurality of them are shown for convenience in the explanation of the cap-opening action.

Figure 4:
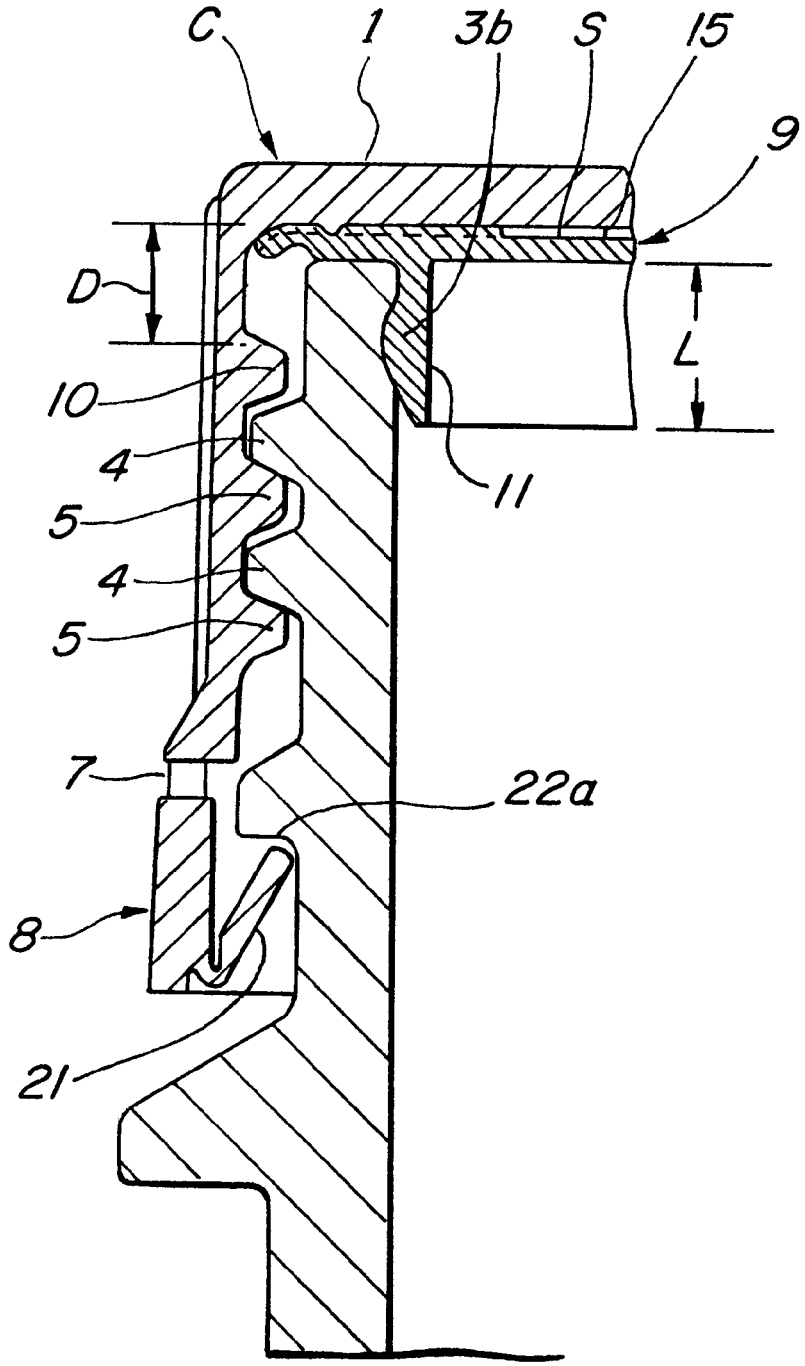
FIG. 4 is a partial cross-sectional view showing the condition that the cap is closed in the above described preferred embodiment.
Figure 5:
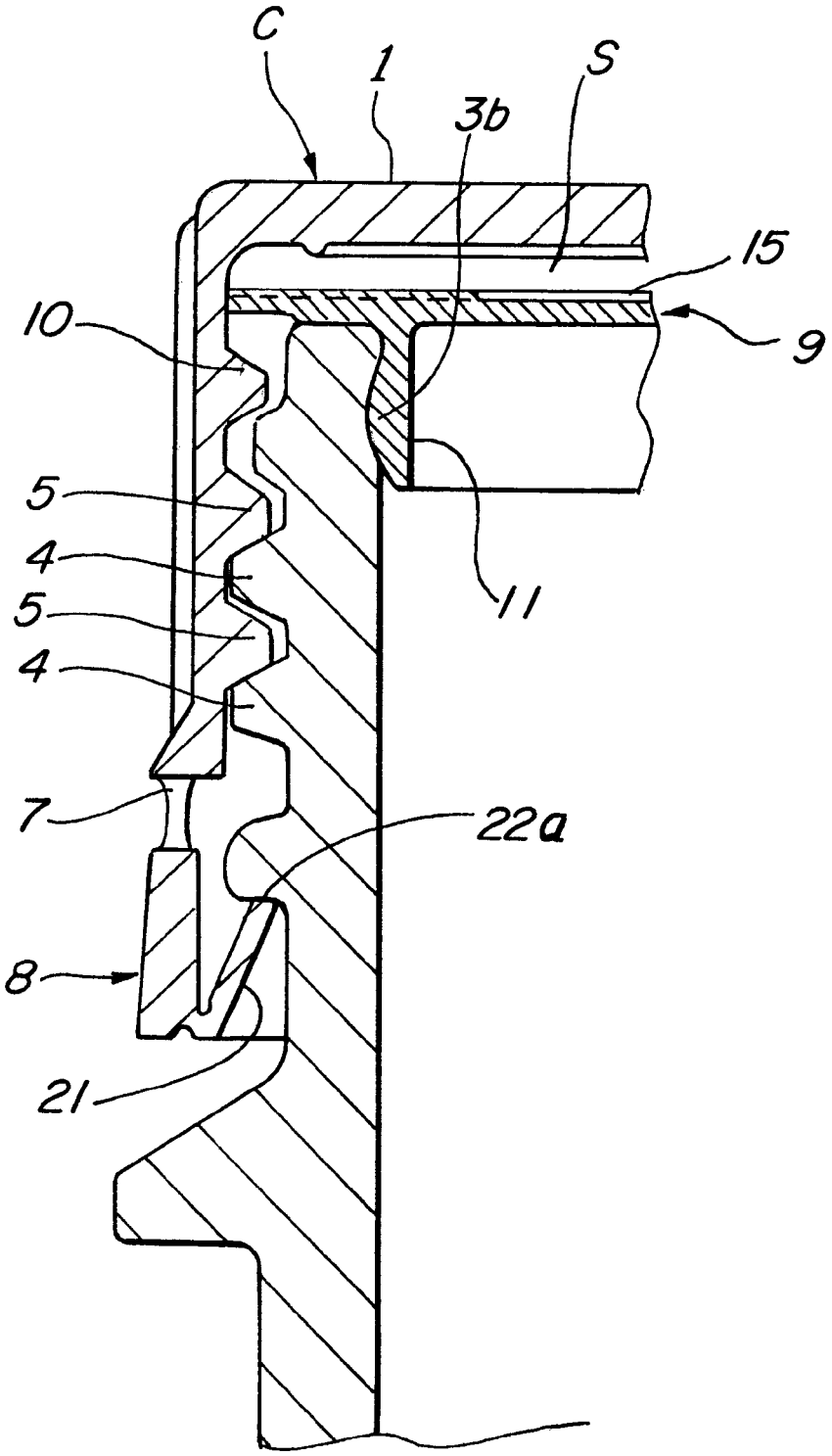
FIG. 5 is a partial cross-sectional view showing a condition that the cap is being loosened in the above described preferred embodiment.

Since the present preferred embodiment has the above described construction, in case of the pilfer-proof cap C made of synthetic resins used for tightly sealing up the container holding the contents therein under the depressurized condition (A), as shown in FIG. 4, when the cap is loosened from the condition that the cap is closed by applying a turning force to the cap 6 in the cap-opening direction, as shown in FIG. 5, not only the air layer S is formed between the lower surface 1*a* of the top wall 1 and the upper surface 9*a* of the packing 9. As a result, the air reservoir or pool 12 is formed, because the air a flows from the outer circumferential surface 3*a* of the mouth portion 3 of the container to the upper surface 9*a* of the packing 9 (refer to FIG. 2), but also the packing 9 has the circular inner sealing member 11 tightly insertable into the inner surface 3*b* of the mouth portion 3 of the container. Thus even though the cap-opening action is conducted to an extent of not fully removing the cap by mischief and the like, the packing 9 can be prevented from being rotated together with the cap, whereby holding the airtightness within the container at least until the bridges 7 are broken in view of the elongation of the bridges 7. After at least the bridges 7 are broken, the packing 9 holding the above described vacuum seal can be lifted up together with the cap 6 by means of the packing guide 10 to open the mouth portion 3 of the container.

As above described, in the present preferred embodiment, the packing 9 is adapted to hold the airtightness against the mouth portion 3 of the container until the bridges 7 are broken when the cap is removed, so that, even though the cap is slightly loosened, the packing 9 is not lifted together with the cap 6 as long as the bridges 7 are not broken.

In addition, even in the case of the pilfer-proof cap made of synthetic resins used for tightly sealing up the container holding the contents therein under the pressurized condition (B) in place of the case of the pilfer-proof cap made of synthetic resins used for tightly sealing up the container holding the contents therein under the depressurized condition (A), a construction similar to that in the above described preferred embodiment or a construction that the packing has the inner sealing member having the appointed length tightly insertable into the inner surface of the mouth portion of the container can exhibit the effects similar to those in the above described preferred embodiment.

Moreover, although the so-called one piece-type PP cap, in which the cap is integrally connected with the PP bands through the bridges and the like, was concerned in the above described preferred embodiment, the present invention can also be applied to the so-called two piece-type PP cap in which the cap and the PP bands are separately formed and integrated before being mounted on the mouth portion of the container.

Figure 6:
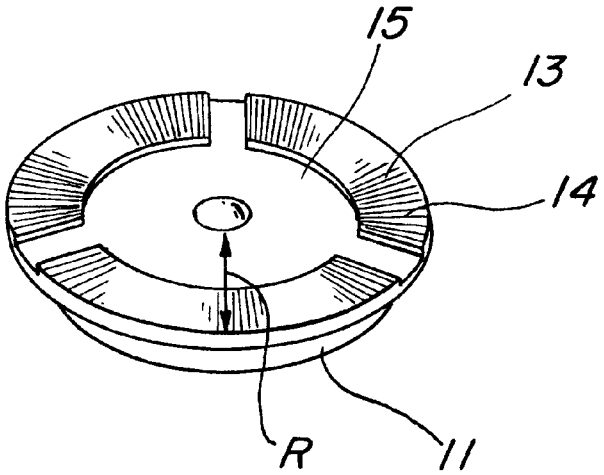
FIG. 6 is a perspective view showing one modification of a packing in the above described preferred embodiment.
Figure 7:
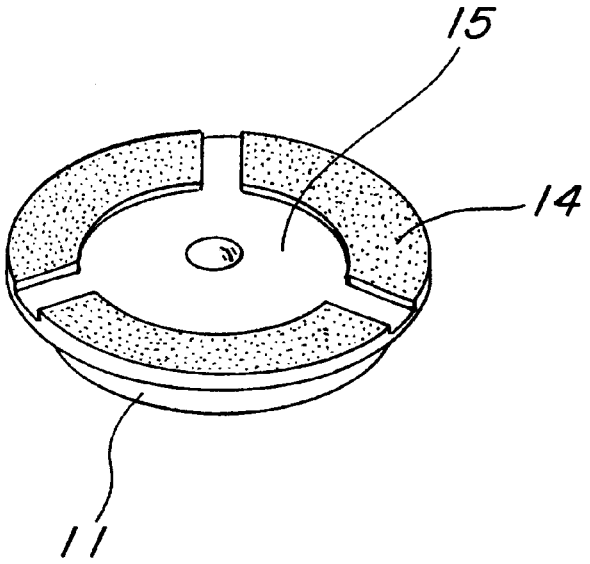
FIG. 7 is a perspective view showing another modification of said packing in the above described preferred embodiment.

Furthermore, modifications of the air reservoir are shown in FIGS. 6 and 7. Referring to FIG. 6, the divided pieces 14 having a plurality of grooves 13 in the radial direction (the R-direction), respectively, and the circular concave portions 15 surrounded by the respective divided pieces 14 are formed in the upper surface of the packing. Referring to FIG. 7, the circular concave portions 15 formed in the upper surface of the packing are surrounded by the divided pieces 14 having a rough surface, respectively.

It goes without saying that the air reservoir or pool similar to that shown in FIGS. 2, 6 and 7 may also be formed in the lower surface of the top wall as shown in FIG. 3.

Besides, the divided pieces may be not only provided with the concentrical grooves formed in the circumferential direction (the H-direction), provided with the grooves formed in the radial direction (the R-direction), or the rough surfaces, as above described, but also provided with checkerboard-like grooves (so-called roulette-like grooves). In short, it is sufficient that the packing can be prevented from being rotated together with the cap.

As described above, in case of the pilfer-proof cap made of synthetic resins used for tightly sealing up the container holding the contents under the depressurized condition, the inside of the container is depressurized to generate a vacuum there when the container is filled with a liquid heat treated at the high temperature or subject to the high-temperature heat treatment after being filled with the liquid followed by being cooled to room temperature, whereby continuing to tightly seal up the mouth portion of the container by the packing as long as the force lifting up the packing is not generated. Consequently, even though the cap-loosening action is conducted to an extent of not fully removing the cap by mischief and the like, the air layer is formed between the lower surface of the top wall and the upper surface of the packing by the air reservoir provided in the upper surface of the packing or the lower surface of the top wall opposite to the upper surface of the packing, so that the packing can be prevented from at least being rotated together with the cap, whereby holding the airtightness within the container at least until the bridges are broken in view of the elongation of the bridges. After at least the bridges are broken, the packing holding the above described vacuum seal can be lifted up together with the cap by means of the packing guide to open the container.

In the case where the contents are held under the pressurized condition, the packing provided with the inner sealing member tightly insertable into the inner surface of the mouth portion of the container is used, so that, even though the cap-loosening action is conducted to an extent of not fully removing the cap by mischief and the like, the packing can be prevented from at least being rotated together with the cap, whereby holding the airtightness within the container. After at least the bridges are broken, the packing holding the seal can be lifted up together with the cap by means of the packing guide to open the container.

Consequently, the effects occur in that the airtightness of the container can be held by the simple construction even though the cap is slightly loosened, and thus the contents can be protected.

What is claimed is:

1. A pilfer-proof cap and packing seal for a container having an aperture with a threaded outer surface comprising:

a cap member having a top wall with no openings therein and a cylindrical side wall, the cylindrical side wall including an inner complementarily threaded surface capable of operatively engaging the threaded outer surface of the container and a packing member for sealing the cap to the container;

a frangible pilfer-proof band mounted at such a portion about a lower edge of the cylindrical side wall that the movement of the cap member to remove it from the container requires a breaking of the pilfer-proof band;

an air reservoir formed between substantially an upper surface of the packing member and a lower surface of the cap member opposite to said upper surface of said packing member for preventing the packing member from adhering to and rotating with the cap member; and a packing guide member mounted on the cylindrical side wall and positioned to contact the packing member to remove it from the container only after the frangible pilfer-proof band is broken, said packing member including a cylindrical insert adjacent the flange for engaging the container aperture, wherein the packing member has a flange of a dimension to extend beyond the aperture and grooves are formed on an exterior surface of said packing member above the flange and divided by radial gaps to permit ambient air to circulate in the grooves.

2. A combination pilfer-proof cap, packing seal, and container comprising:

a container having an upper mouth portion with an aperture, an outer surface of the mouth portion having a threaded surface and a lower shoulder portion;

a cap member having a top wall and a cylindrical side wall, the cylindrical side wall including an inner complementarily threaded surface capable of operatively engaging the threaded outer surface of the container;

a packing guide member mounted on the cap member between the threaded surface and the top wall and spaced a predetermined distance from the top wall;

a packing member for sealing the upper mouth aperture and having a flange portion for extending sufficiently beyond the mouth portion of the container for enabling an engagement with the packing guide member when the cap member is unsealed from the container;

a sealing member extending from the packing member for sealing engagement with the inner surface of the aperture;

means for providing an air reservoir communicating with ambient air between the top wall of the cap member and an upper surface of the packing, including a circumferential groove pattern on an exterior surface of the packing member with radial gaps separating the groove pattern, the air reservoir extends across the upper surface of the packing member for preventing the packing member from adhering to and rotating with the cap member; and a frangible pilfer-proof band mounted at such a portion about a lower edge of the cap member cylindrical side wall and around the container lower shoulder portion that the movement of the cap member requires a breaking of the pilfer-proof band prior to engagement of the packing guide member with the packing member, the predetermined distance positioning the packing guide member sufficiently below the flange portion of the packing member so that a rotational unthreading of the cap member will break the frangible pilfer-proof band before any unsealing of the packing member from the container aperture.

3. An security cap and packing seal for a container having an aperture with a threaded outer surface comprising:

a cap member having a top wall and a cylindrical side wall, the cylindrical side wall including an inner complementarily threaded surface capable of operatively engaging the threaded outer surface of the container and a packing member for sealing the cap to the container;

a frangible sealing band mounted at such a portion about a lower edge of the cylindrical side wall that the movement of the cap member to remove it from the container requires a breaking of the sealing band; and a packing guide member mounted on the cylindrical side wall and positioned to contact the packing member to remove it from the container only after the frangible sealing band is broken, the packing member has a flange of a dimension to extend beyond the aperture and grooves are formed above the flange on the packing member and divided by radial gaps to permit ambient air to circulate in the grooves, wherein an air reservoir extends across an upper surface of the packing member for preventing the packing member from adhering to and rotating with the cap.

4. A pilfer-proof cap and packing seal for a container having an aperture with a threaded outer surface comprising:

a cap member having a top wall with no openings therein and a cylindrical side wall, the cylindrical side wall including an inner complementarily threaded surface capable of operatively engaging the threaded outer surface of the container; and a packing member for sealing the cap to the container, said packing member having a flange of a dimension to extend beyond the aperture;

a frangible pilfer-proof band mounted at such a portion about a lower edge of the cylindrical side wall that the movement of the cap member to remove it from the container requires a breaking of the pilfer-proof band;

a packing guide member mounted on the cylindrical side wall and positioned to contact the packing member to remove it from the container only after the frangible pilfer-proof band is broken;

the packing member being provided with an air reservoir formed in a substantially whole upper surface thereof or an air reservoir is provided in a substantially whole lower surface of the top wall opposite to said upper surface of the packing; and the air reservoir having divided pieces having a rough surface only on a peripheral area.

5. A combination pilfer-proof cap, packing seal, and container comprising:

a container having an upper mouth portion with an aperture, an outer surface of the mouth portion having a threaded surface and a lower shoulder portion;

a cap member having a top wall and a cylindrical side wall, the cylindrical side wall including an inner complementarily threaded surface capable of operatively engaging the threaded outer surface of the container;

a packing guide member mounted on the cap member between the threaded surface and top wall and spaced a predetermined distance from the top wall;

a packing member for sealing the upper mouth aperture and having a flange portion for extending sufficiently beyond the mouth portion of the container for enabling an engagement with the packing guide member when the cap member is unsealed from the container, said packing member further comprising a groove pattern extending circumferentially about an exterior surface to provide the air reservoir above the packing member to prevent the packing member from adhering to and rotating with the cap member, with radial gaps separating the groove pattern into divided pieces;

a nearly cylindrical sealing member extending from the packing member for sealing engagement with the inner surface of the aperture;

an air reservoir formed in one of a substantially whole upper surface of the packing member and a substantially whole lower surface of the top wall opposite to said upper surface of the packing member for preventing the packing member from adhering to and rotating with the cap member; and a frangible pilfer-proof band mounted at such a portion about a lower edge of the cap member cylindrical side wall and around the container lower bead portion that the movement of the cap member requires a breaking of the pilfer-proof band prior to engagement of the packing guide member with the packing member, the predetermined distance positioning the packing guide member sufficiently below the flange portion of the packing member so that a rotational unthreading of the cap member will break the frangible pilfer-proof band before any unsealing of the packing member from the container aperture.

6. The combination pilfer-proof cap, packing seal, and container of claim 5, further including a circular central concave portion with the groove pattern extending about the periphery of the circular central concave portion and the radial gaps extending from the circular central concave portion to an outer periphery of the flange portion.

7. The combination pilfer-proof cap, packing seal, and container of claim 6 wherein an interior of the top wall has an annular rim projection for engaging a top surface of the flange portion.

8. The combination pilfer-proof cap, packing seal, and container of claim 6 wherein the threaded surface of the container has a vertical gap separating the threaded surface to enable ambient air to communicate with the radial gaps on the packing member.

9. The combination pilfer-proof cap, packing seal, and container of claim 5 wherein the threaded surface of the container has a vertical gap separating the threaded surface to enable ambient air to communicate with the radial gaps on the packing member.

10. The combination pilfer-proof cap, packing seal, and container of claim 5, wherein the upper surface of the packing member and the lower surface of the wall are vertically spaced from each other at a central position and only contact each other along substantially a peripheral position, and wherein the peripheral position includes a plurality of arcuate contact lines between the packing member and the top wall.

11. The combination pilfer-proof cap, packing seal, and container of claim 5, wherein the upper surface of the packing member and the lower surface of the wall are vertically spaced from each other at a central position and only contact each other along substantially a peripheral position, and wherein the peripheral position includes a plurality of radial contact lines between the packing member and the top wall.

12. The improved combination pilfer-proof cap, packing seal, and container of claim 5, wherein the upper surface of the packing member and the lower surface of the wall are vertically spaced from each other at a central position and only contact each other along substantially a peripheral position, and wherein the peripheral position includes a plurality of rough surface contact between the packing member and the top wall.

13. A pilfer-proof cap made of synthetic resins comprising a cap, in which a top wall and a skirt depending from said top wall are comprised and a threaded portion of the cap screwed on threaded portion of a mouth portion of a container is proved in an inner circumferential surface of said skirt, a pilfer-proof band integrally connected with said cap through a plurality of bridges and a packing provided so as to tightly seal up said mouth portion of the container during the time when said cap is closed, characterized in that an airtightness of the mouth portion of the container by said packing is held until said bridges are broken, a packing guide positioned on the skirt at a predetermined position so that it is only capable of lifting up the packing above the mouth portion of the container when the bridges are broken, the packing being provided with a nearly cylindrical inner sealing member airtightly insertable into an inner surface of the mouth portion of the container, and for preventing the packaging from adhering to and rotating with the cap, the packing being provided with an air reservoir formed in one of a substantially entire upper surface thereof and a substantially entire lower surface of the top wall opposite to said surface of the packing:

wherein the upper surface of the packing and the lower surface of the top wall are vertically spaced from each other at a central and only contact each other along substantially a peripheral position; and wherein the peripheral position includes a plurality of arcuate contact lines between the packing and the top wall.

14. A pilfer-proof cap made of synthetic resins comprising a cap, in which a top wall and a skirt depending from said top wall are comprised and a threaded portion of the cap screwed on a threaded portion of a mouth portion of a container is provided in an inner circumferential surface of said skirt, a pilfer-proof band integrally connected with said cap through a plurality of bridges and a packing provided so as to tightly seal up said mouth portion of the container during the time when said cap is closed, characterized in that an airtightness of the mouth portion of the container by said packing is held until said bridges are broken, a packing guide positioned on the skirt at a predetermined position so that it is only capable of lifting up the packing above the mouth portion of the container when the bridges are broken, the packing being provided with a nearly cylindrical inner scaling member airtightly insertable into an inner surface of the mouth portion of the container, and for preventing the packaging from adhering to and rotating with the cap, the packing being provided with an air reservoir formed in one of a substantially entire upper surface thereof and a substantially entire lower surface of the top wall opposite to said surface of the packing:

wherein the upper surface of the packing and the lower surface of the top wall are vertically spaced from each other at a central position and only contact each other along substantially a peripheral position; and wherein the peripheral position includes a plurality of radial contact lines between the packing and the top wall.

15. A pilfer-proof cap made of synthetic resins comprising a cap, in which a top wall and a skirt depending from said top wall are comprised and a threaded potion of the cap screwed on a threaded portion of a mouth portion of a container is provided in an inner circumferential surface of said skirt, a pilfer-proof band integrally connected with said cap through a plurality of bridges and a packing provided so as to tightly seal up said mouth portion of the container during the time when said cap is closed, characterized in that an airtightness of the mouth portion of the container by said packing is held until said bridges are broken, a packing guide positioned on the skirt at a predetermined position so that it is only capable of lifting up the packing above the mouth portion of the container when the bridges are broken, the packing being provided with a nearly cylindrical inner sealing member airtightly insertable into an inner surface of the mouth portion of the container, and for preventing the packaging from adhering to and rotating with the cap, the packing being provided with an air reservoir formed in one of a substantially entire upper surface thereof and a substantially entire lower surface of the top wall opposite to said surface of the packing:

wherein the upper surface of the packing and the lower surface of the top wall are vertically spaced from each other at a central position and only contact each other along substantially a peripheral position; and wherein the peripheral position includes a plurality of rough surface contacts between the packing and the top wall.

* * * * *